US011412800B2

(12) United States Patent
Ng

(10) Patent No.: US 11,412,800 B2
(45) **Date of Patent: *Aug. 16, 2022**

(54) ATTACHABLE PERSONAL COOLING FANS

(71) Applicant: Richard Ng, Phoenixville, PA (US)

(72) Inventor: Richard Ng, Phoenixville, PA (US)

(73) Assignee: Richard Ng, Phoenixville, PA (US)

( * ) Notice: Subject to any disclaimer, the term of this patent is extended or adjusted under 35 U.S.C. 154(b) by 67 days.

This patent is subject to a terminal disclaimer.

(21) Appl. No.: 16/873,953

(22) Filed: Aug. 27, 2020

(65) Prior Publication Data

US 2022/0061441 A1 Mar. 3, 2022

(51) Int. Cl.

| | |
|---|---|
| ***A42B 1/008*** | (2021.01) |
| ***A63B 71/10*** | (2006.01) |
| ***A63B 71/00*** | (2006.01) |
| ***F04D 25/08*** | (2006.01) |

(52) U.S. Cl.

CPC ..... *A42B 1/008* (2013.01); *A63B 71/0054* (2013.01); *A63B 71/10* (2013.01); *F04D 25/084* (2013.01); *A63B 2071/0063* (2013.01); *A63B 2225/66* (2013.01); *F24F 2221/38* (2013.01)

(58) Field of Classification Search

CPC ..... A42B 1/008; A63B 71/10; A63B 2225/66; F24F 2221/38; F03D 25/084; F04D 25/084

See application file for complete search history.

(56) References Cited

U.S. PATENT DOCUMENTS

| | | | | |
|---|---|---|---|---|
| 10,677,263 | B2 | 6/2020 | Ng | |
| 2016/0255901 | A1 * | 9/2016 | Jeon | A42B 3/286 |
| 2020/0229965 | A1 * | 7/2020 | Guzman | A42B 1/245 |
| 2021/0379415 | A1 * | 12/2021 | Choi | A62B 18/006 |

FOREIGN PATENT DOCUMENTS

CN 111202296 A * 5/2020

OTHER PUBLICATIONS

YourTechGuide; Youtube.com video; https://www.youtube.com/watch?v=MXTaCUjORhM; accessed Dec. 14, 2021; published Sep. 9, 2013. (Year: 2013).*

* cited by examiner

*Primary Examiner* — Daniel J Colilla

(57) ABSTRACT

This invention relates to attachable personal cooling fans specifically designed to provide several hours of cooling for the user. These units were originally designed for baseball/softball plate umpires for hot weather conditions, however, they could be adapted for other uses. The units are portable and lightweight and can be attached to any facemask.

1 Claim, 3 Drawing Sheets

ATTACHABLE PERSONAL COOLING FANS

BACKGROUND OF THE INVENTION

Umpiring baseball and softball games requires that umpires remain cool, calm and collected to make the right calls and deal with the players, coaches and fans. The task becomes even more difficult when the weather is hot and humid.

Umpiring the plate is extremely exhausting because of the protective gear underneath and the facemask on the face. Professional umpires may only do one or two games a day, however, the recreational umpire who does tournaments may do six games in a day.

In hot and humid summer weather, there is a high potential for heat related illness. It is necessary for the umpires to stay cool. There are devices and methods to keep the umpires cool such as placing ice inside the chest protector, wet cold rags around the neck, ice cubes inside your hat, etc. All these devices and methods do not provide a long lasting cooling effect and can be messy.

Cooling the head offers a very effective method to prevent heat related illnesses. The cooling unit for the plate umpire is attached to the facemask. It is located behind the cage of the facemask where it is protected from any balls hitting the facemask.

The attachable units include 5V, 0.14-0.15A fans powered by AA or AAA batteries. The batteries may be single use or rechargeable. Any type of battery capable of supplying the required power to the fans will work. Tests show that the fans run continuously for 8 hours using four AA batteries and about 4 hours using four AAA batteries. Button batteries which supply the power will not last long. There is no need for a detached battery power pack with umbilical cord.

Presently, there are no devices on the market to provide this type of cooling for the umpires.

BRIEF SUMMARY OF INVENTION

The invention is an attachable personal cooling fan unit that can be attached to any facemask. The unit was originally designed for baseball and softball umpires, but can be applied to any head gear for cooling purposes.

The attachable unit includes two 5V fans powered by AA or AAA batteries. The batteries may be single use or rechargeable. Any type of battery capable of supplying the required power to the fans will work. Tests show that the fans run continuously for 8 hours using four AA batteries and about 4 hours using four AAA batteries. Button batteries that supply the power will not last long. The battery power packs are attached to the fans.

The advantages of this unit include:

1. Can be attached to any type of facemask.
2. Provide cooling to the user for up to 8 hours.
3. Are not noticeable.
4. Do not hinder visibility.
5. No umbilical cord or separate power source.
6. Lightweight
7. Easily attached and removed
8. Quiet Presently, there are no devices on the market to provide this type of cooling for the umpires.

Two 50 mm 5V fans each wired and attached to a battery case holding 2 AA batteries.

An on/off switch (toggle, slide, push-button) attached to one of the battery cases.

Figure 2:
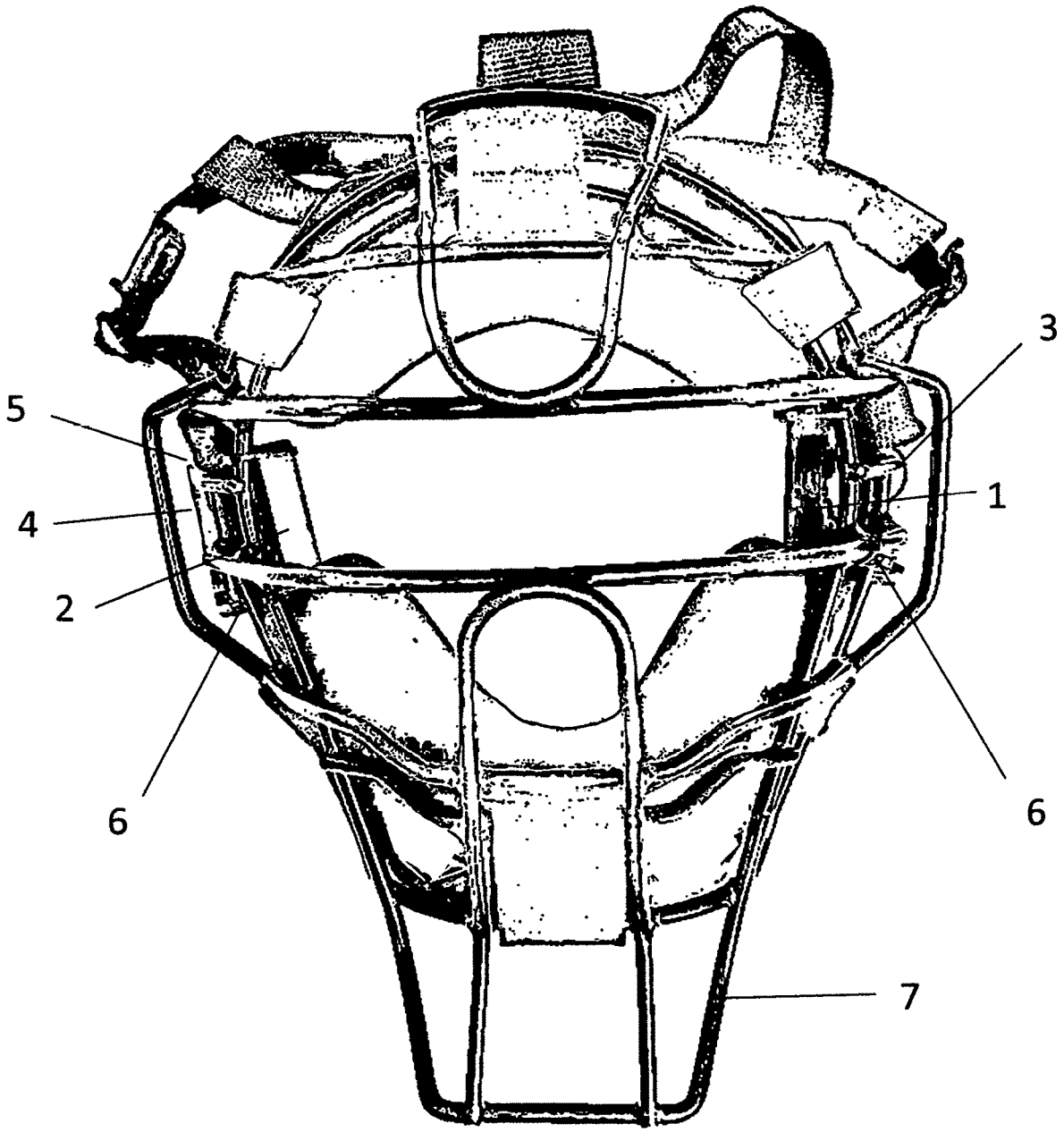

FIG. 2: Front view of attachable cooling fans with battery pack attached to the face mask.

The fans are attached with zip ties to the frame on the sides.

The battery pack is glued to the fans.

The wires are attached along the frame of the mask by the padding straps.

Figure 3:
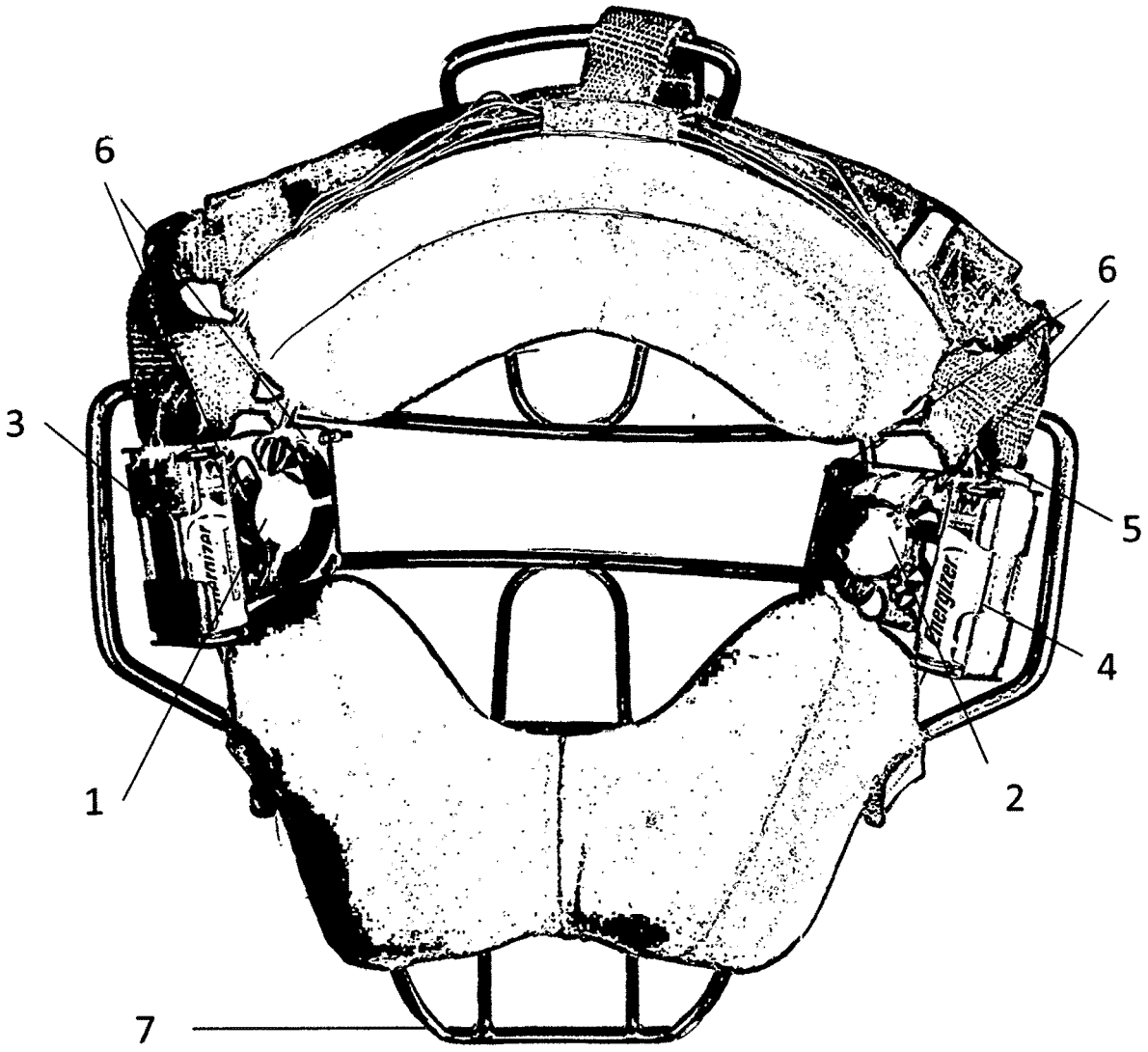

FIG. 3: Back view of attachable cooling fans with battery pack for face mask.

DETAILED DESCRIPTION OF DRAWINGS

Figure 1:
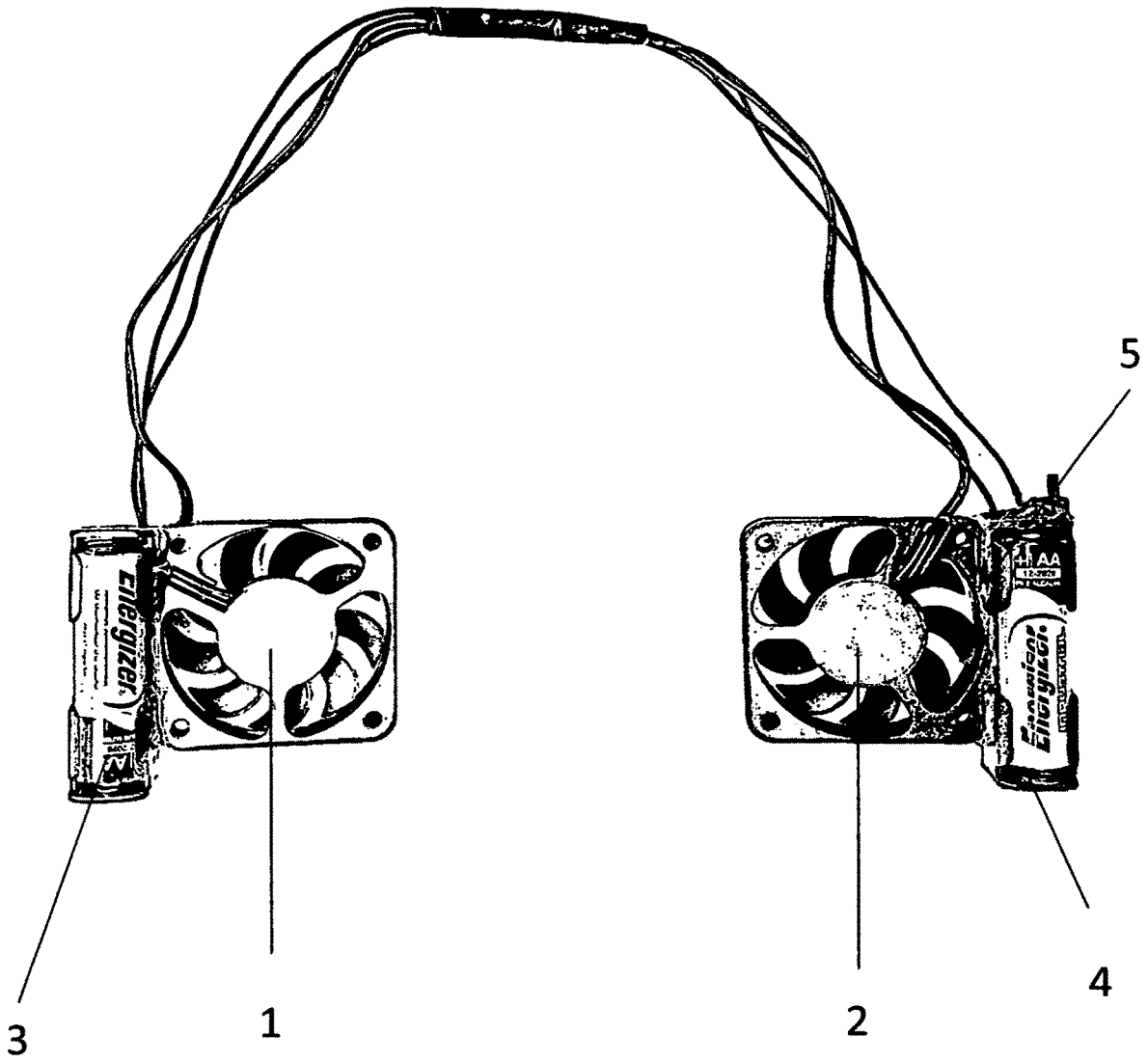
FIG. 1: Front view of attachable cooling fans (two) with battery packs for face mask.

FIG. 1: Front view of attachable cooling fans 1,2 with battery packs 3,4 for face mask.

Two 50 mm 5V fans 1,2 wired and each attached to a battery pack holding 2 AA batteries 3,4.

There is an on/off switch (toggle, slide, push-button) 5 on one battery pack 4.

FIG. 2: Front view of the attachable cooling fans 1,2 with battery packs 3,4 attached to the face mask 7.

The fans are attached with zip ties 6 to the inside frame on the left and right sides.

FIG. 3: Back view of attachable cooling fans 1-2 with battery packs 3,4 for face mask 7.

The fans are placed between the upper and lower face pads on the left and right sides.

The invention claimed is:

1. An attachable personal cooling apparatus comprising:

two fans each fixed to a respective battery pack;

an on/off switch attached to one of said respective battery packs; and the two fans with battery packs wired together:

wherein the personal cooling apparatus is attached to an umpire facemask comprising:

a frame comprising a plurality of bars with space in between the bars which allows the umpire to see but prevents balls from penetrating the facemask:

padding attached to an inside of the frame and configured to be placed between the frame and the umpire's face to absorb impact from a ball striking the face mask:

wherein the fans with battery packs are attached to the inside of the frame and located on left and right sides of the frame, respectively, in order to minimize obstructions to the umpire's view and to prevent a ball from directly striking the fans and battery packs.

* * * * *